US005603668A

United States Patent [19]

Antonious

[11] Patent Number: 5,603,668

[45] Date of Patent: Feb. 18, 1997

[54] IRON TYPE GOLF CLUB HEAD WITH IMPROVED SOLE CONFIGURATION

[76] Inventor: Anthony J. Antonious, 7738 Calle Facil, Sarasota, Fla. 34238

[21] Appl. No.: 420,877

[22] Filed: Apr. 13, 1995

[51] Int. Cl.[6] ..... A63B 53/04

[52] U.S. Cl. ..... 473/328; 473/350

[58] Field of Search ..... 273/167 R, 77 R, 273/167 A, 167 D, 174, 169, 167 H, 170, 171, 193 R, 194 R, 187.4, 194 A, 194 B, 162 R, 164.1; D21/219, 220; 473/324–350, 287–292, 282, 219, 226

[56] References Cited

U.S. PATENT DOCUMENTS

| | | | |
|---|---|---|---|
| D. 215,608 | 10/1969 | Lysaght | 273/167 A X |
| D. 217,567 | 5/1970 | Williams | 273/167 A |
| 1,089,881 | 3/1914 | Taylor | 273/167 A |
| 1,128,288 | 2/1915 | Churchill . | |
| 1,505,296 | 8/1924 | Smith . | |
| 1,835,718 | 12/1931 | Morton . | |
| 3,064,975 | 11/1962 | Smith | 273/167 A |
| 3,166,320 | 1/1965 | Onions | 273/167 A |
| 3,810,631 | 5/1974 | Braly | 273/167 A |
| 3,830,080 | 8/1974 | Consoli . | |
| 3,862,503 | 1/1975 | Evans et al. . | |
| 3,997,170 | 12/1976 | Goldberg | 273/167 A |
| 4,000,902 | 1/1977 | Perkins | 273/167 A |
| 4,332,388 | 6/1982 | Crow | 273/167 A |
| 4,498,673 | 2/1985 | Swanson | 273/174 |
| 5,125,662 | 6/1992 | Antonious | 273/167 A |
| 5,154,423 | 10/1992 | Antonious | 273/167 A |
| 5,314,184 | 5/1994 | Schmidt | 273/167 A |
| 5,377,983 | 1/1995 | Fenton . | |
| 5,474,297 | 12/1995 | Levin | 273/167 A |

*Primary Examiner*—Sebastiano Passaniti

*Attorney, Agent, or Firm*—Finnegan, Henderson, Farabow, Garrett & Dunner, L.L.P.

[57] ABSTRACT

An iron type golf club head with an improved sole construction including cavities and/or projections in various shapes. The cavities and projections on the sole are spaced behind the leading edge of the club head and include a substantially vertical wall facing the leading edge of the golf club head.

41 Claims, 8 Drawing Sheets

IRON TYPE GOLF CLUB HEAD WITH IMPROVED SOLE CONFIGURATION

BACKGROUND OF THE INVENTION

The present inention relates to golf clubs and more particular to iron type golf club heads with an improved sole configuration.

Conventional iron-type golf clubs, particularly wedges and other higher loft irons, have smooth bottoms or sole surfaces. Sand wedges usually have bounce which reacts with the sand or earth to produce club head action which lifts a golf ball to the target. Often these shots are not properly executed resulting in the ball not getting out of the hazard when not enough sand is moved to lift the ball. When these golf clubs are used in the fairway and ground contact is made behind the ball, the club head can bounce upward causing the ball to be "skulled" or "bladed," producing disastrous results. Conventional iron-type golf clubs with a smooth sole surface also have a tendency to bounce, causing the same problems, although normally to a lesser degree.

Conventional wedges, when used to play a ball out of a trap, rely on the bounce configuration of the sole to facilitate contacting the sand and to prevent the leading edge of the club from digging into the sand too deeply. When addressing a ball in a sand bunker, the club must be held aloft in a hovering position to avoid grounding or touching the sand, which incurs a penalty in accordance with the rules of golf. Furthermore, the golf club is usually laid open, further exposing the sole to the sand surface when such a shot is required. Thus, these clubs are designed to hit down into the sand, behind the ball, in order to move sand at the ball, which in turn, moves the ball out of the bunker to the target. However, unless a player has great skill, the shot can be difficult since hitting down into the sand causes a majority of the sand to fly upward, with a large portion of the sand missing the ball completely, Since the surface of the sole, forming the bounce portion, is relatively smooth, only a limited amount of sand is generally directed at the ball to lift it out of the bunker.

Prior art patents which teach the modification of the sole of the golf club include the patents to Churchill U.S. Pat. No. (1,128,288), Smith U.S. Pat. No. (1,505,296), Morton U.S. Pat. No. (1,835,718), Consoli U.S. Pat. No. (3,830,503), Evans et al. U.S. Pat. No. (3,862,759), and Fenton U.S. Pat. No. (5,377,983), among others.

SUMMARY OF THE INVENTION

The present invention provides an iron-type golf club having an improved sole configuration. One aspect of the improved sole configuration is to facilitate gently lofting a ball from sand traps by increasing the volume of sand directed precisely at the ball. Because of the greater volume of sand propelled directly at the ball, the trajectory and roll of the ball is dramatically effected, causing the ball to land more softly and with more controlled backspin. As a result, when the ball lands, it rolls straight rather than spinning or turning to the side as with conventional clubs. Another aspect of the improved sole configuration of the present invention is to minimize or eliminate the bounce of the club head when hitting a ball from the grass or ground and improve the club head's tracking ability.

The iron-type golf clubs of the present invention have soles which are dramatically different from the smooth soles of conventional iron-type golf clubs. In one embodiment, the sole is formed with a deep cavity depression cut or formed in the sole of the club head and aligned in the heel to toe direction. Other embodiments use a series of deep depressions in the sole, aligned in a heel to toe direction. Still other embodiments use a series of spaced protuberances and/or raised members on the sole arranged in a heel to toe direction. All of these various embodiments act to move a greater amount of sand directly at the ball creating an improved shot result from a bunker. These embodiments also provide a roughened sole which is less prone to bounce and more prone to track and keep low when the ball is struck.

A pair of raised, narrow projections adjacent the trailing edge of the club can be added to any of the above embodiments.

An object of the present invention is the provision of iron-type golf clubs having an improved sole configuration.

Another object is the provision of a iron-type sand golf club which moves a greater volume of sand directly at a ball to move a ball from the bunker.

Still another object is the provision of a iron-type sand golf club having a sole configuration which allows a ball played from sand to have more backspin permitting it to land softly and straighter. Another object is to provide a club having a sole configuration which produces a more solid and controlled ball hit from the fairway or the rough.

The present invention, especially the wedge-type iron clubs, provide greater versatility. For example, the pitching wedge, with a 46° face loft, can be "laid-back" to open up to a 75° face loft club when used to hit trap or sand shots.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms and shapes. Therefore, the details disclosed herein are not to be interpreted as limiting, but merely as the basis for the claims and as a basis for teaching one skilled in the art how to make and/or use the invention.

The present invention represents an improvement over conventional iron-type golf clubs which have a relatively smooth sole or bottom surface, particularly in a heel to toe direction. When these types of clubs make ground contact behind the ball, a so-called "fat" shot results. Even worse, the club head can bounce upwardly causing the ball to be "skulled" or "bladed," producing a totally disastrous shot. These types of poor shots can occur whether the club head bottom has bounce or not.

With the iron-type golf clubs of the present invention, the occurrence of these type of shots is minimized or totally eliminated because of the action of the various formations of depressions or protuberances on the sole of the club head when ground contact is made. When the club contacts the ground behind the ball, unlike the soles of conventional clubs, the unique formations on the sole of the present invention cause the club head to adhere to the ground surface, immediately stabilizing the club head with minimum of lateral or upward movement. This permits the club head to maintain a longer parallel relationship to the ground surface allowing the club head to stay "on-track" toward the ball, thereby increasing the chance of the club making solid contact with the ball. Thus the golf clubs of the present invention provide improved equipment that enables any golfer to favorably execute a golf shot under a wide variety of conditions, not only from bunkers and sand traps, but also from more favorable locations including tees, fairways, and the rough.

Figure 1:
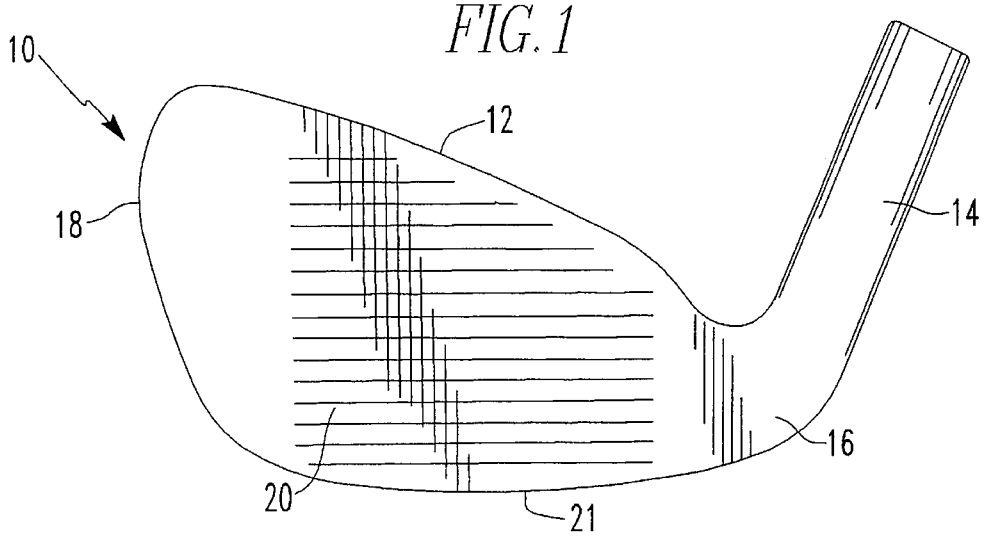
FIG. 1 is a front elevational view of a first embodiment of the iron-type golf club of the present invention.
Figure 2:
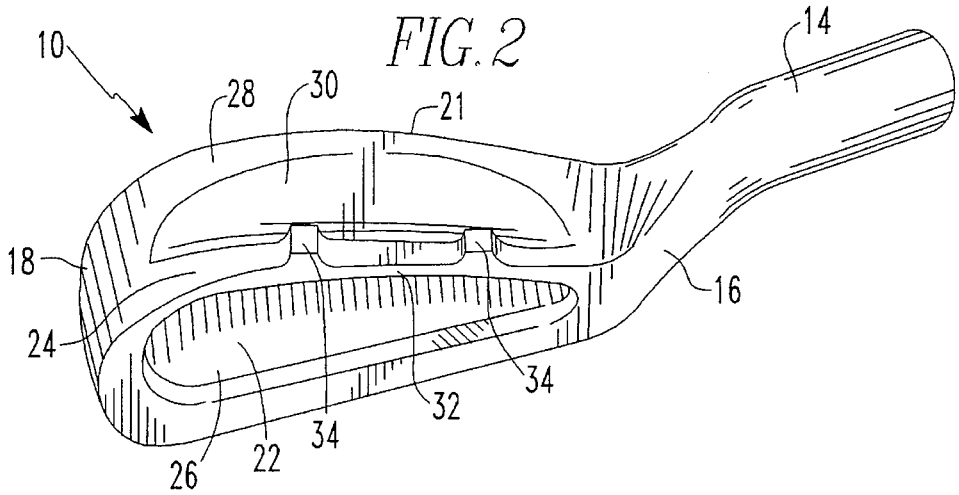
FIG. 2 is a bottom view of the club of FIG. 1.
Figure 3:
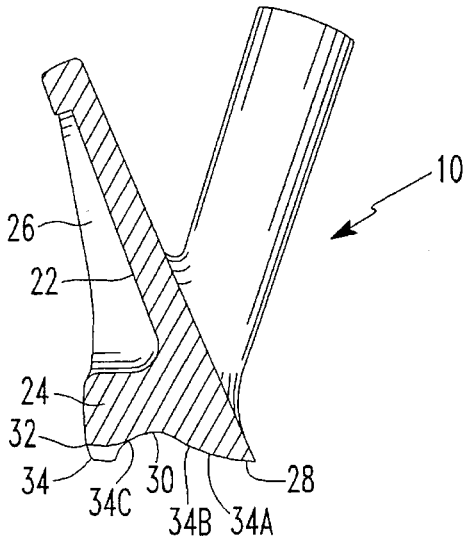
FIG. 3 is a cross section of FIG. 2.

Referring to FIGS. 1 through 3, a golf club 10 of the present invention includes a club head body 12, a hosel 14, a heel 16, a toe 18, a ball striking face 20, having a leading edge 21 at the forwardmost progression of the ball striking face 20, a rear surface 22, a rear peripheral weight 24 defining a rear peripheral cavity 26, and a bottom surface or sole 28. A cavity depression 30 is formed in the sole 28 and has a width that is at least one quarter of the width of the sole 28 (i.e., approximately 0.250–0.350 of an inch, depending on the sole width of the specific club) between the leading edge 21 and a trailing edge 32 of the club head 10. The cavity depression 20, or the protuberances in the later embodiments, extends at least 30% of the distance between the heel 16 and toe 18 in the preferred embodiments, at least 50% of the distance in the more preferred embodiments, and at least 70% of the distance in the most preferred embodiments.

As shown in FIG. 3, the cavity depression 30 has a leading edge 34A, a sloping surface 34B, and a rear wall 34C, as shown in FIGS. 2 and 3. The leading edge of the depression is spaced slightly rearwardly of the leading edge of the club head and in this embodiment is arcuate in shape. The cavity progressively becomes deeper from the front to rear (approximately 0.250 of an inch at its deepest point), thereby providing a sloping wall 34B which begins at the sole of the club head and ends at the rearward face 34C of the depression. The rear wall 34C preferably is perpendicular or approximately perpendicular to the sole of the club head and provides a surface which serves as a wall or scoop-like means to catch and propel the sand forwardly along a relative low trajectory. The depression 30 also eliminates the bounce in conventional wedges and irons, thereby minimizing or eliminating the tendency of the club to "bounce" and "skull" a shot.

The trailing edge 32 of the club head 10 is provided with at least one and preferably a pair of narrow projections 34 which extend outwardly from the sole 28 adjacent the trailing edge 32.

The narrow projections 34 are positioned behind the depression 30, or positioned preferably on opposite sides of the center of gravity of the club head, and generally extend front to back along the rear of the sole. These projections, approximately 0.125 of an inch in height, width and length, increase the ability of the club head 10 to track and keep in the proper swing plane throughout the swing. These projections 34 particularly increase the ability of the club head to track the fairway and rough, when combined with the non-bouncing aspect of the depression 30 of the club head. As will be apparent when discussing the invention, these narrow projections 34 can be added to the other disclosed embodiments of the present invention.

Figure 20:
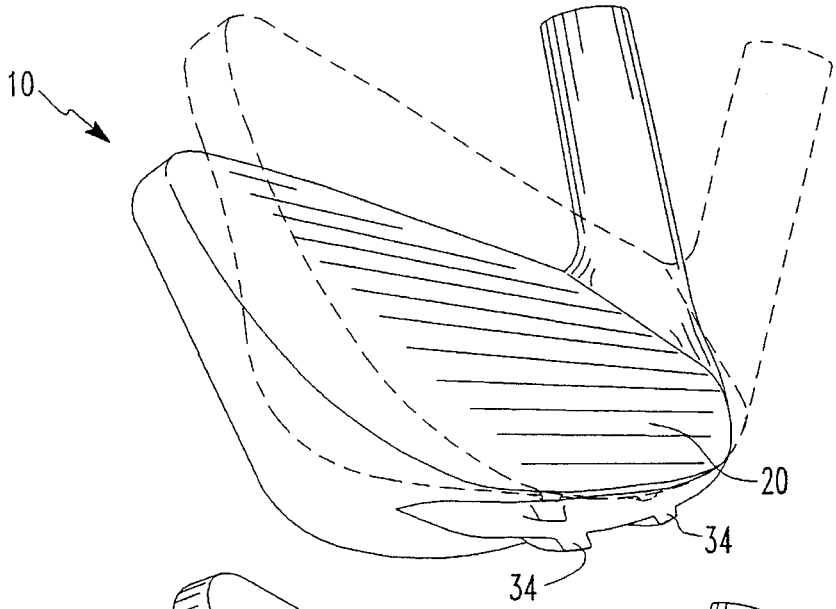
FIG. 20 is a perspective view of the golf club of FIG. 1.
Figure 21:
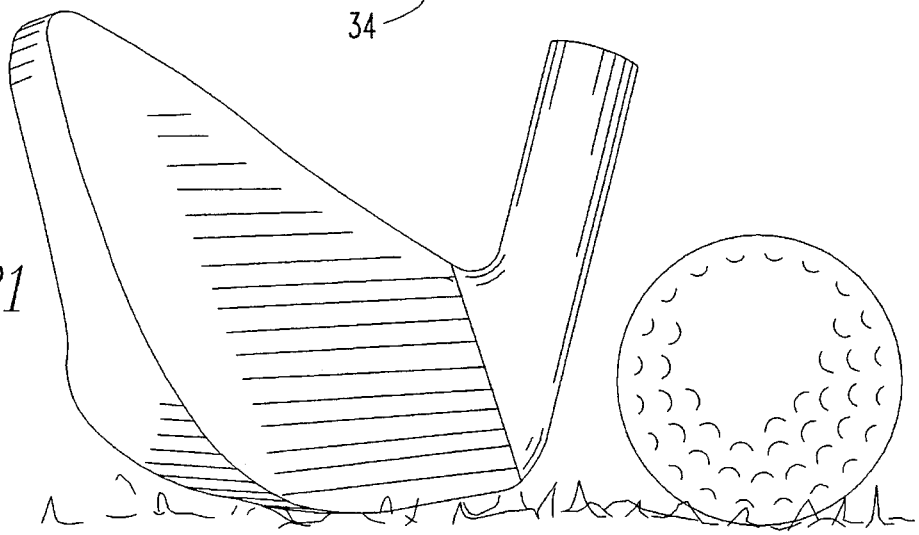
FIG. 21 is a perspective view of the golf club of FIG. 1 addressing a golf ball.
Figure 22:
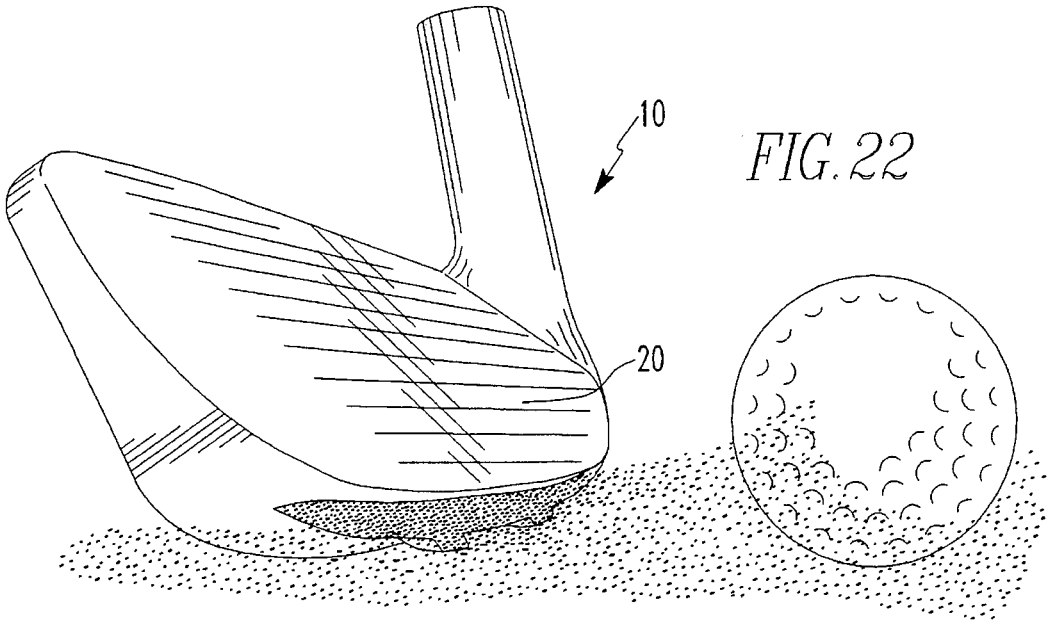
FIG. 22 is a view of the golf club of FIG. 1 hitting a ball out of a sand bunker.

As can be seen with reference to FIGS. 20 and 22, laying the face 20 of the club head 10 open, exposes the cavity depression 30 which captures or "scoop-up" a greater volume of sand than a smooth "bounce" type sole surface and thereby throws more sand directly at the ball when a sand shot is executed.

The design of the cavity, in particular the rear wall 34C, is such that the sand moved is more controlled along a relatively low trajectory so that the sand is propelled toward the ball and carries the ball upwardly and out of the trap, particularly when the club face is open, as shown in FIG. 22. When the club is used in fairway or rough shots and held in a conventional non-opened position, the depression and projections tend to eliminate bouncing and torquing of the club head, providing a more solid and controlled shot.

Figure 4:
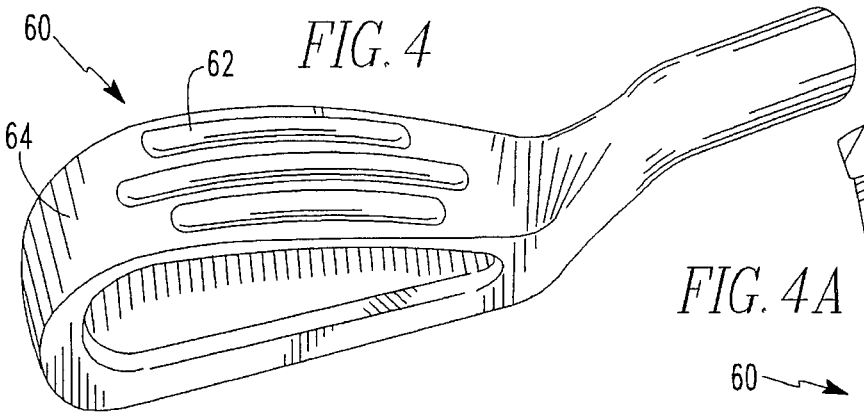
FIG. 4 is a bottom view of a second embodiment of the golf club of the present invention.
Figure 4A:
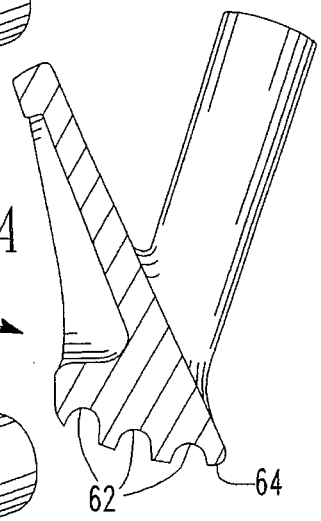
FIG. 4A is a cross section of FIG. 4.

FIGS. 4 and 4A show a second embodiment of a golf club 60 of the present invention which is formed with a series of substantially deep and elongated grooves 62 on the sole 64 of the golf club 60. The grooves 62, approximately 0.090–0.125 of an inch deep and 0.100–0.200 of an inch wide, are generally parallel to each other and extend in an heel to toe direction. In this embodiment, grooves 62 have a generally semicircular cross section, thereby providing upstanding, arcuate walls at the rear of each of the three elongated grooves, these walls serving to throw sand at the same trajectory discussed with respect to the embodiment in FIGS. 1–3. These grooves 62 also provide a rough surface on the club head 60 which tends to eliminate bouncing and provides better control while hitting shots from the fairways and rough.

Figure 5:
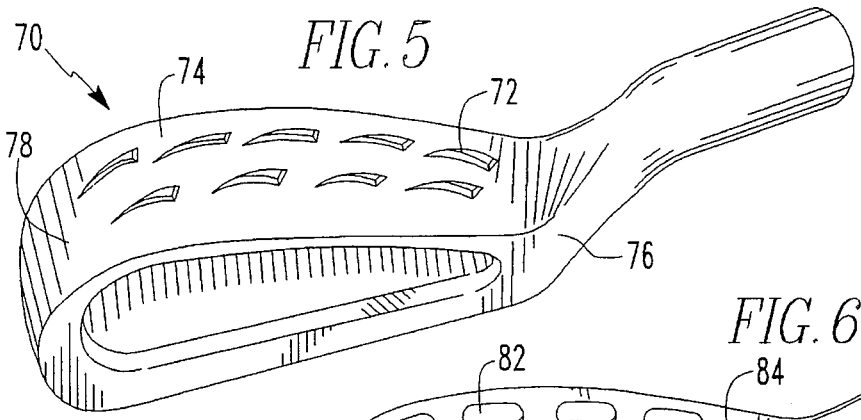
FIG. 5 is a bottom view of a third embodiment of the golf club of the present invention.

FIG. 5 shows a third embodiment of the golf club 70 formed with a series of half-moon shaped depressions 72 in an array on the sole 74 of club 70. Each depression 72 has a longitudinal axis in a heel to toe direction, and the depressions 72 extend along substantially the entire length of the sole 74 in a heel 76 to toe 78 direction. Preferably, each of these depressions 72 is formed with a leading edge, sloping wall, and substantial perpendicular rear wall similar to that shown in FIG. 1–3, but obviously smaller in size. The series of depressions 72 create a series of upright walls which throw a wider pattern of sand directly to the ball when used in sand shots. In addition, the depressions 72 provide a roughened sole which improves the ability of the club head to.stay down and allows a solid hit when used in the fairways and rough.

Figure 6:
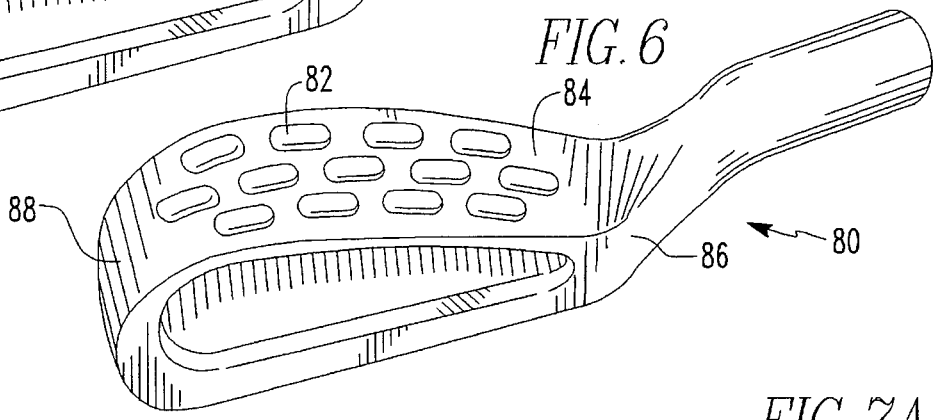
FIG. 6 is a bottom view of a fourth embodiment of the golf club of the present invention.

FIG. 6 shows a fourth embodiment of golf club 80 of the present invention formed with a series of oval-shaped; deep depressions 82 in an array on the sole 84 and oriented in a heel 86 to toe 88 direction. The cross sectional shape of these depressions 82 is essentially the same as that shown in FIG. 4. The three rows of depressions throw sand in a similar manner as the embodiment in FIG. 4, and provides a roughened surface on the sole 84 in a front to rear and heel to toe direction.

Figure 7:
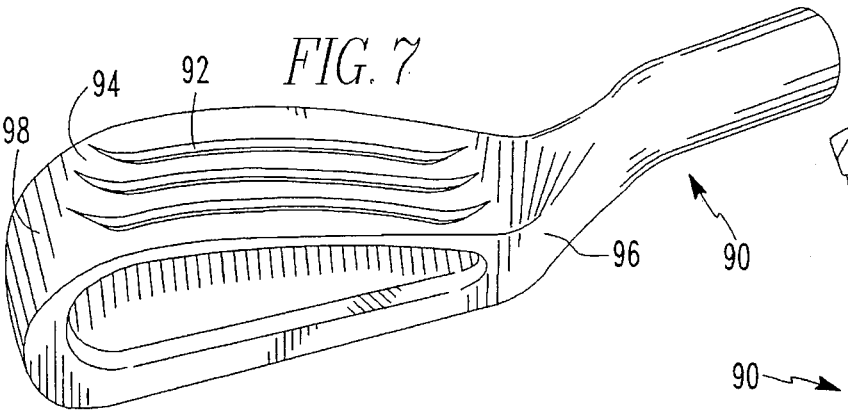
FIG. 7 is a bottom view of a fifth embodiment of the golf club of the present invention.
Figure 7A:
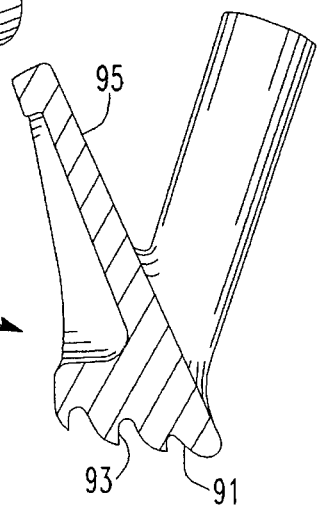
FIG. 7A is a sectional view taken along line 7A—7A of FIG. 7.

FIG. 7 shows a fifth embodiment of golf club 90 of the present invention formed with a series of depressions 92 having flared ends 94. The depressions 92 are formed on a sole 94 of the golf club 90 in a heel 96 to a toe 98 direction. Each of the depressions increases in depth from the front to the rear, providing a sloping surface 91 and a substantially perpendicular end wall 93 to catch and throw sand. Because the end of each of these three depressions 92 are turned slightly toward the face 95, the end walls 93 form a scoop directing the sand forwardly. As shown in FIG. 7A, the resultant club head has a substantially saw tooth arrangement with the end walls 93 substantially perpendicular to the sole.

Figure 8:
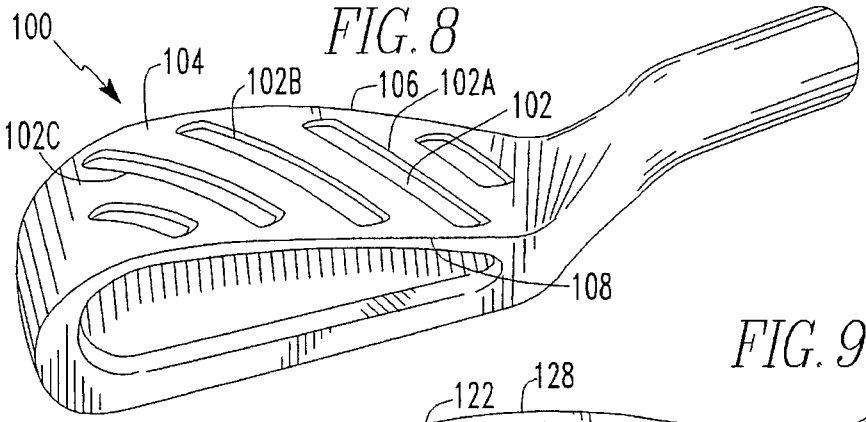
FIG. 8 is a bottom view of a sixth embodiment of the golf club of the present.invention.

FIG. 8 shows a sixth embodiment of a golf club 100 formed with a series of deep wide grooves 102 on the sole 104 of the club head 100. The deep wide grooves 102 are disposed at an angle relative to the leading edge 106 and the trailing edge 108 of the club head 100. Each of these angled deep wide grooves 102 has a leading edge 102A, a sloping surface 102B, and a rear wall 102C, which is substantially perpendicular to the sole 104. This embodiment is particularly suited for golfers who have an outside-in swing.

Figure 9:
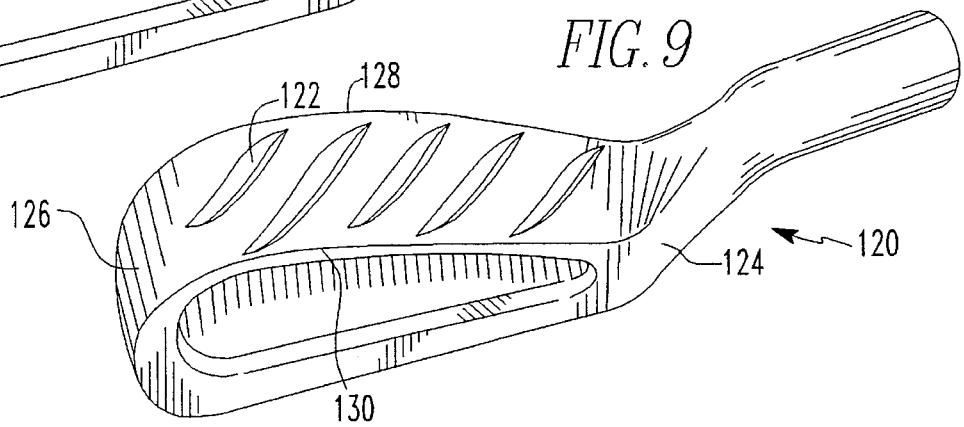
FIG. 9 is a bottom view of a seventh embodiment of the present invention.

FIG. 9 shows a seventh embodiment of the club head 120 formed with a series of wide, deep grooves 122 located between the heel 124 and the toe 126 and positioned at approximately an angle of 45° with respect to the leading edge 128 and the trailing edge 130 of the club head 120. These deep wide grooves are formed in substantially the same manner as those shown in FIG. 8, with the exception that they are inclined in opposite directions. In both this and the embodiment shown in FIG. 8, the deep wide groove progressively deepens from front to rear, thereby forming a rear wall or face which effectively serves as a scoop. This embodiment favors the golfer with an inside-out swing.

Figure 10:
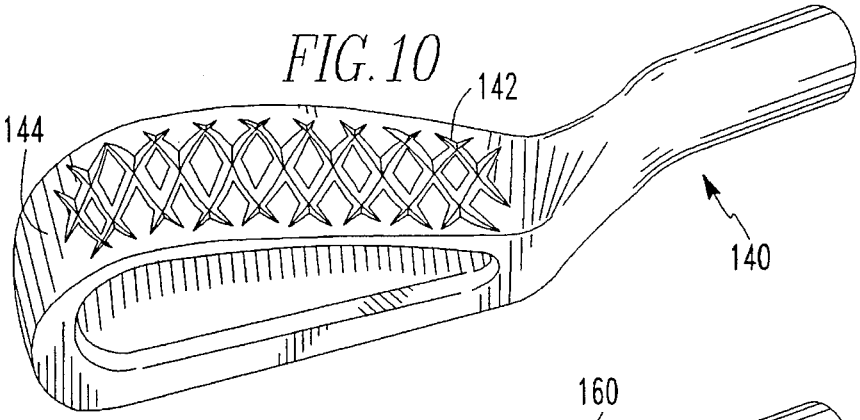
FIG. 10 is a bottom view of an eighth embodiment of the present invention.

FIG. 10 shows an eighth embodiment of a golf club head 140 formed with an array of depressions 142 in the sole 144 forming a waffle-type or cross-hatched configuaration and extending between the heel 146 and toe 148 of the golf club head 140. In effect, the depressions 142 include a combination of the depressions shown in FIGS. 8 and 9, thereby providing a cross-hatching in which each depression from front to rear progressively deepens and provides a substantially perpendicular rear wall which is substantially perpendicular to the sole. This embodiments throws out a uniform spray of sand when used on a sand iron and also provides a rough surface and sole configuration which enhances the ability of the club head to stay down and track, when hit in roughs and fairways.

Figure 11:
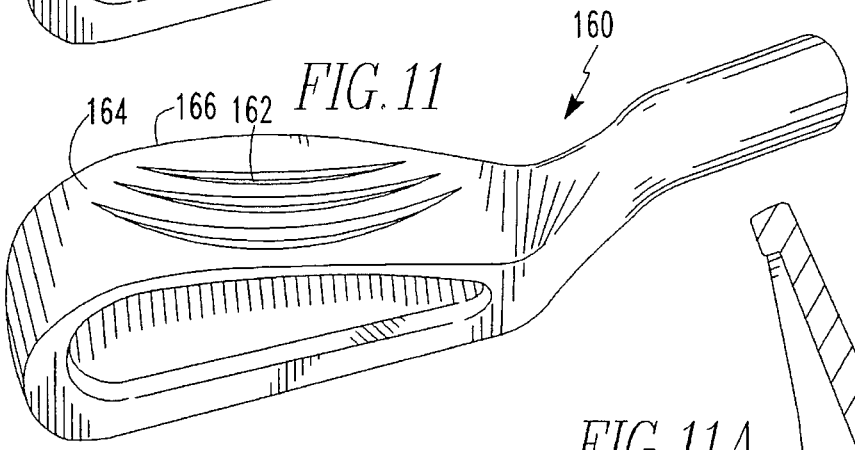
FIG. 11 is a bottom view of a ninth embodiment of the present invention.
Figure 11A:
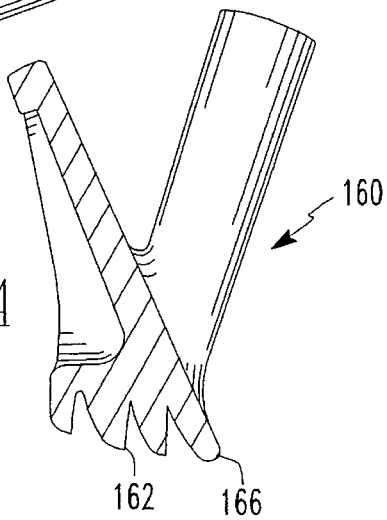
FIG. 11A is a sectional view taken along the line 11A—11A of FIG. 11.

FIGS. 11 and liA show a ninth embodiment of a club head 160 having three elongated grooves 162 in the sole 164 which are curved in a direction toward the leading edge 166 of the club head 160. Again, each of the elongated grooves 162 progressively increases in depth from front to rear, to an approximate maximum depth of 0.125–0.250 of an inch and width of approximately 0.090–0.125 of inch, and has a rear wall which is substantially perpendicular to the sole. This relationship is best shown in FIG. 11A.

Figure 12:
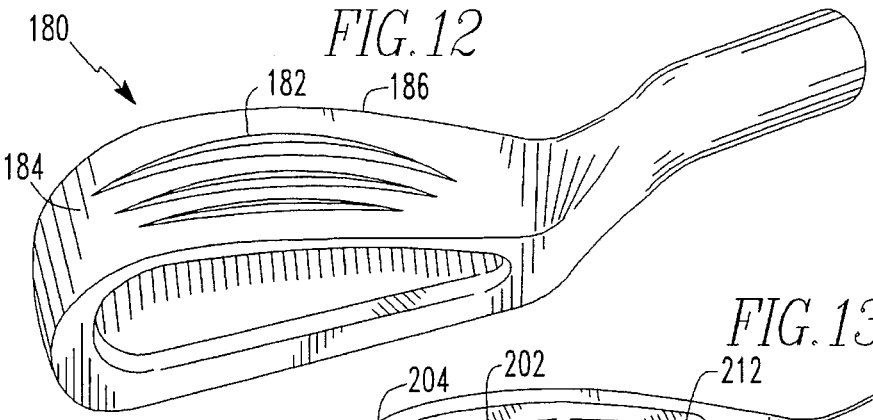
FIG. 12 is a bottom view of a tenth embodiment of the present invention.

FIG. 12 shows a tenth embodiment of a club head 180 having three parallel elongated grooves 182 in the sole 184 which are curved in a direction toward the leading edge 186 of the club head 180. Again, the elongated grooves 182 progressively increase in depth from front to rear and have a rear wall substantially perpendicular to the sole of the club head and have the same approximate dimensions as in FIG. 11. In this embodiment, the elongated grooves 182 generate a wider spray of sand when used for sand shots.

Figure 13:
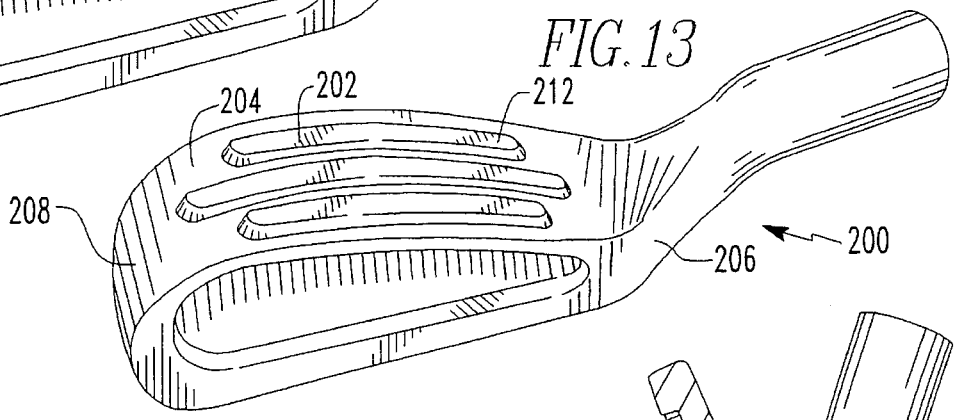
FIG. 13 is a bottom view of an eleventh embodiment of the present invention.
Figure 13A:
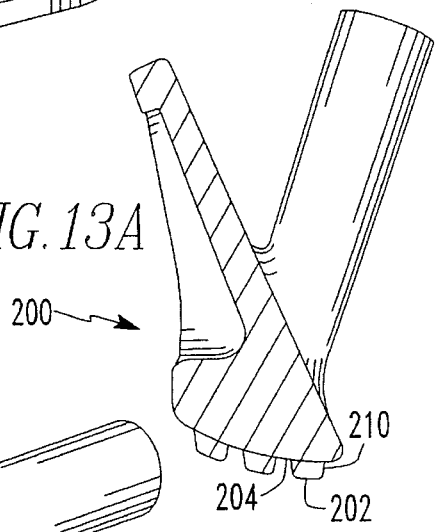
FIG. 13A is a cross section of FIG. 13.

FIGS. 13 and 13A show an eleventh embodiment of a club head 200 having a series of elongated parallel protuberances or stud-type projections 202 extending approximately 0.075–0.125 of an inch above the sole 204 between the heel 206 and the toe 208. In this embodiment projections 202 form, at their frontal surface 210, upright, longitudinal walls which catch and throw sand, in a manner like the rear wall of the depressions of the previous embodiments. At least the frontal surfaces 210 of these ridges are substantially perpendicular to the sole 204 of the club head. In this embodiment, the top surfaces 212 of the projections 202 are approximately 0.100–0.250 of an inch wide and are substantially parallel to the sole 204.

Figure 14:
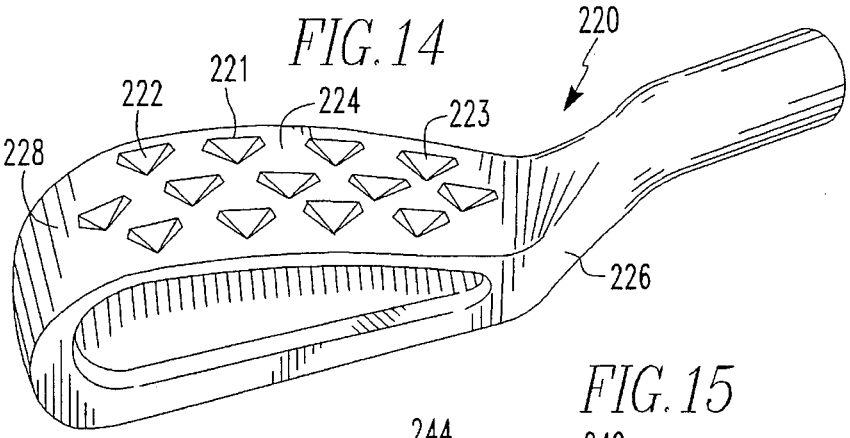
FIG. 14 is a bottom view of a twelfth embodiment of the present invention.

FIGS. 14 shows a twelfth embodiment of a club head 220 formed with an array of triangular projections 222 on the sole 224 between the heel 226 and the toe 228 of the club head 220. In this embodiment, each triangular projection 222 has a front wall 221 substantially perpendicular to the sole 224 of the club head 220 and has a top surface 223 which is inclined relative to the sole 224 and progressively lessens in height in a front to rear direction. In this arrangement, it enhances the ability of the more rearward faces of the projections to scoop the sand and more widely project it forwardly.

Figure 15:
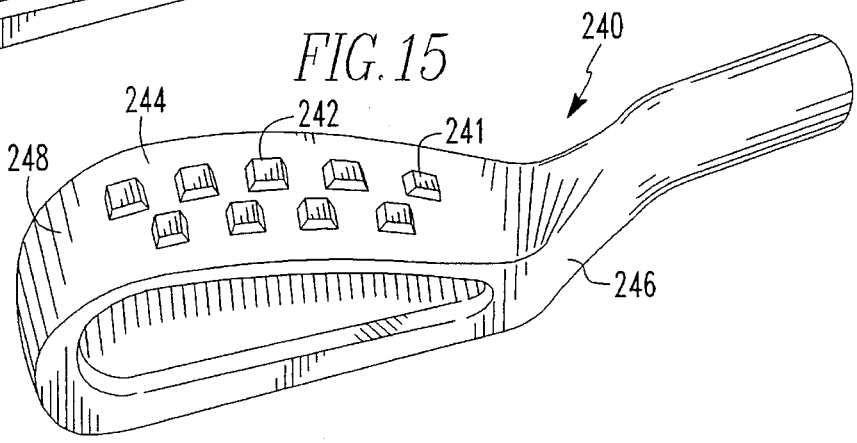
FIG. 15 is a bottom view of a thirteenth embodiment of the present invention.

FIG. 15 shows a thirteenth embodiment of a club head 240 having a series of square projections 242 extending outwardly from the sole 244 between the heel 246 and the toe 248. In this embodiment, there are two rows of square projections 242 approximately 0.100–0.250 of an inch square, the second row being positioned so that the two rows in combination provide a frontal wall surface 241 along substantially the entire length of the sole 244. The frontal surface 241 of each square is approximately 0.100–0.250 of an inch high and substantially perpendicular to the sole 244, while the remaining three sides are tapered or rounded.

Figure 16:
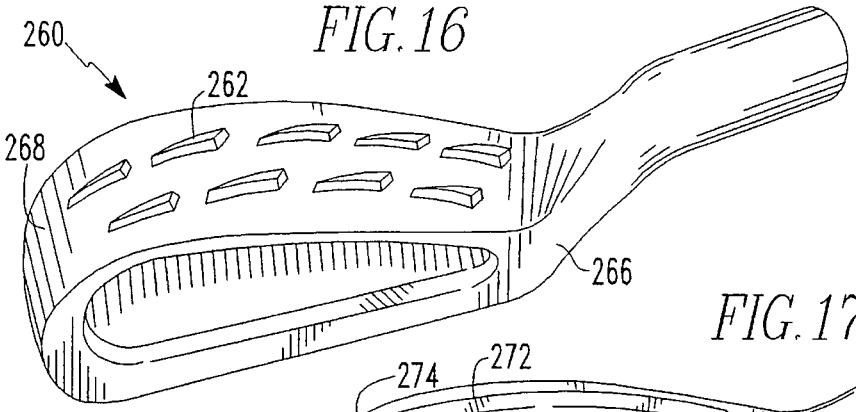
FIG. 16 is a bottom view of a fourteenth embodiment of the present invention.

FIG. 16 shows a fourteenth embodiment of the club head 260 formed with two rows of generally triangular projections 262 extending above the sole 264 between the heel 266 and the toe 268. As with the embodiment in FIG. 15, the projections are formed in two rows, the second row positioned so that the two rows provide a frontal wall surface substantially the entire length of the sole.

Figure 17:
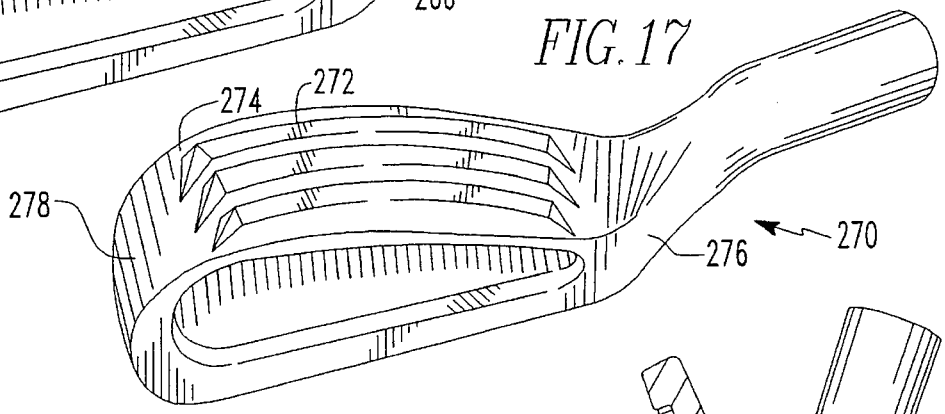
FIG. 17 is a bottom view of a fifteenth embodiment of the present invention.
Figure 17A:
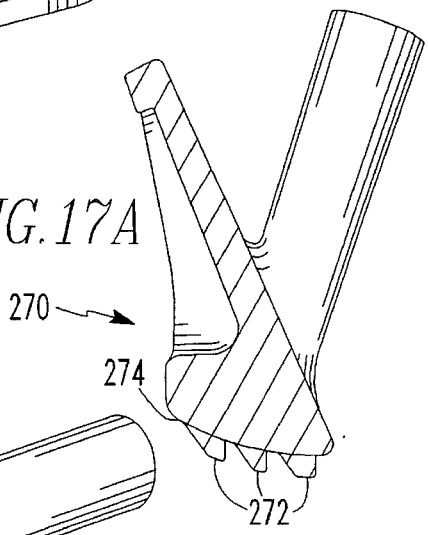
FIG. 17A is a cross section of FIG. 17.

FIGS. 17 and 17A show a fifteenth embodiment of the club head 270 formed with a plurality of three elongated projections 272 extending above the sole 274 and the heel 276 to toe 278 direction. As can best be seen in FIG. 17A, these projections 272 are preferably triangular in cross section, each having a front wall substantially perpendicular to the sole and top surface which slopes from the top of the wall toward the sole. As shown in FIG. 17, the longitudinal projections 272 at their respective ends are also inclined from the top of the wall outwardly to the sole 274.

Figure 18:
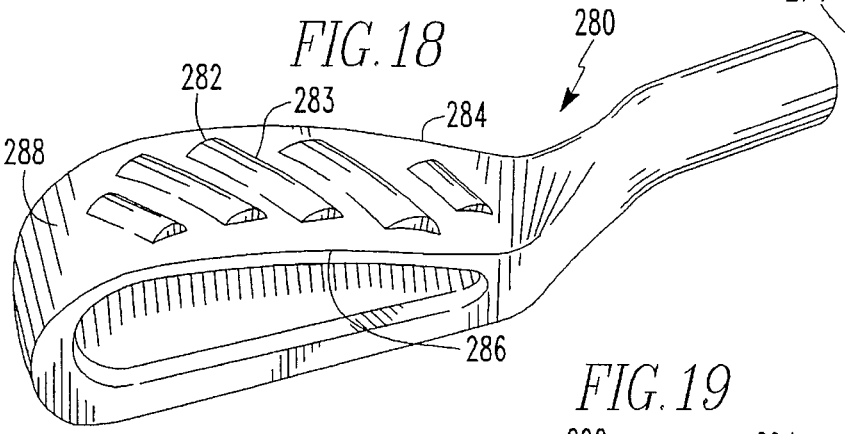
FIG. 18 is a bottom view of a sixteenth embodiment of the present invention.

FIG. 18 shows a sixteenth embodiment of the club head 280 having a series of inclined projections or ribs 282 positioned at approximately an angle of 45° with respect to the leading edge 284 and the trailing edge 286 of the club head. As shown, these ribs are substantially triangular in cross section, having a front surface 283 generally perpendicular to the sole 288 of the club head.

Figure 19:
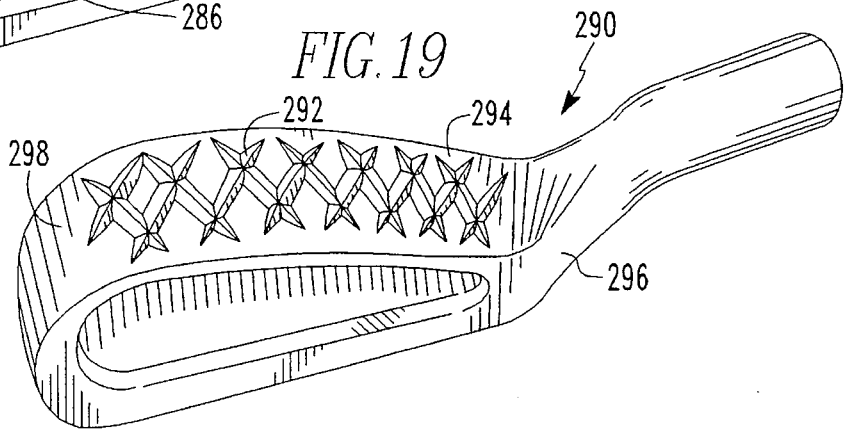
FIG. 19 is a bottom view of a seventeenth embodiment of the present invention.

FIG. 19 shows a seventeenth embodiment of the club head 290 having an array of raised ribs 292 on sole 294 forming a waffle-type or cross-hatching configuration extending between the heel 296 and the toe 298 of the club head. This embodiment operates similar to other embodiments with arrays or groups of projections on the sole.

Figure 23:
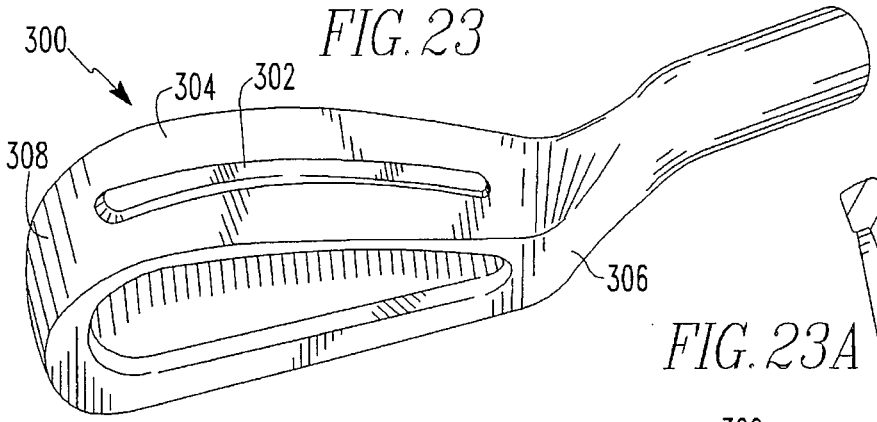
FIG. 23 is a bottom view of a eighteenth embodiment of the present invention.
Figure 23A:
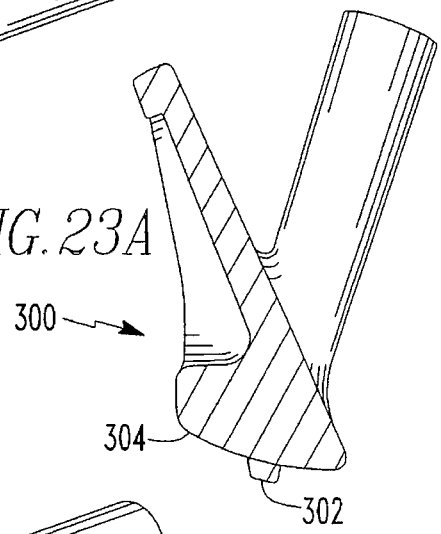
FIG. 23A is a sectional view taken along line 23A—23A of FIG. 23.

FIGS. 23 and 23A show a eighteenth embodiment of a club head 300 formed with a single longitudinal rib-type projection 302 extending outwardly from the sole 304 between the heel 306 and the toe 308 of the club head. The rib-type projection 302 is similar in cross section to the rib-type projections shown in FIG. 13 and provides a only single wall surface of approximately 0.075–0.200 of an inch high and 0.100–0.250 of an inch wide for engaging and moving sand at the ball during a sand shot.

Figure 24:
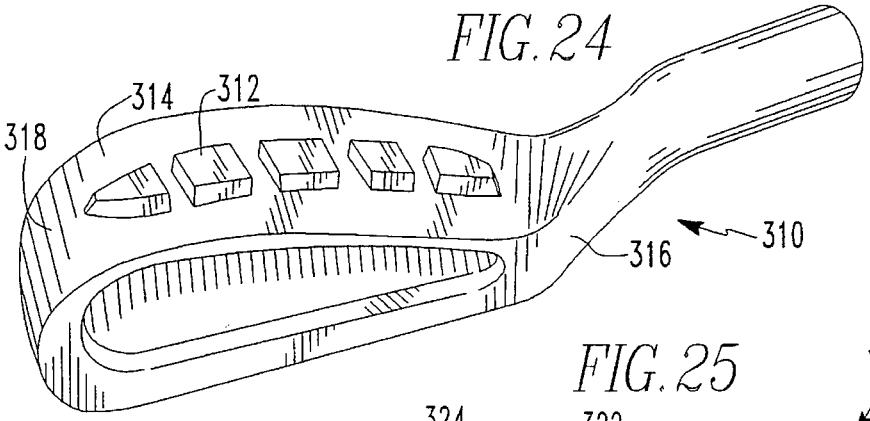
FIG. 24 is a bottom view of a nineteenth embodiment of the present invention.

FIG. 24 shows a nineteenth embodiment of club head 310 formed with a row of spaced projections 312 on the sole 314 between the heel 316 and the toe 318 of the club head. In this embodiment, the central projections are substantially square or rectangular in shape and the end projections are triangular or trapezoidal shaped at the heel and toe respectively. As with the other embodiments with projections, the forward surface of the projections are generally perpendicular to the sole 314.

Figure 25:
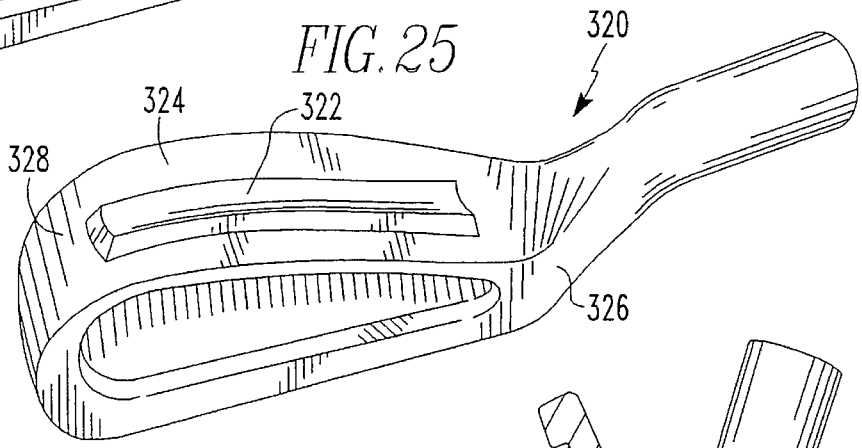
FIG. 25 is a bottom view of a twentieth embodiment of the present invention.
Figure 25A:
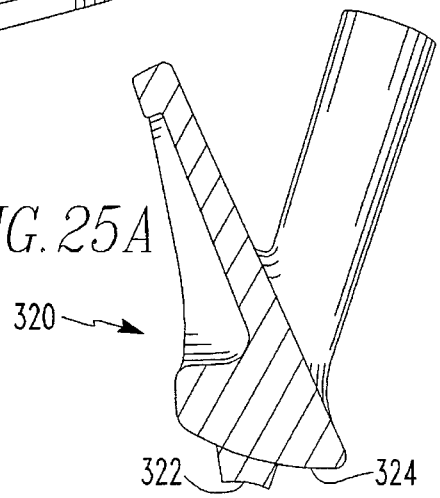
FIG. 25A is a sectional view taken along line 25A—25A of FIG. 25.

FIGS. 25 and 25A show a twentieth embodiment of club head 320 formed with a single longitudinal rib-type projection 322 extending above the sole 324 in a heel 326 to toe 328 direction. This single rib-type projection extends substantially along the entire length of the sole 324. As shown in FIG. 25A, this embodiment has a concave upper surface 321 of approximately 0.075–0.200 of an inch high and 0.125–0.350 of an inch wide behind the leading wall 323. This concave surface increases the ability of the club head to stay down, particularly during shots made in the fairway and rough or "hard-pan" type surfaces.

Figure 26:
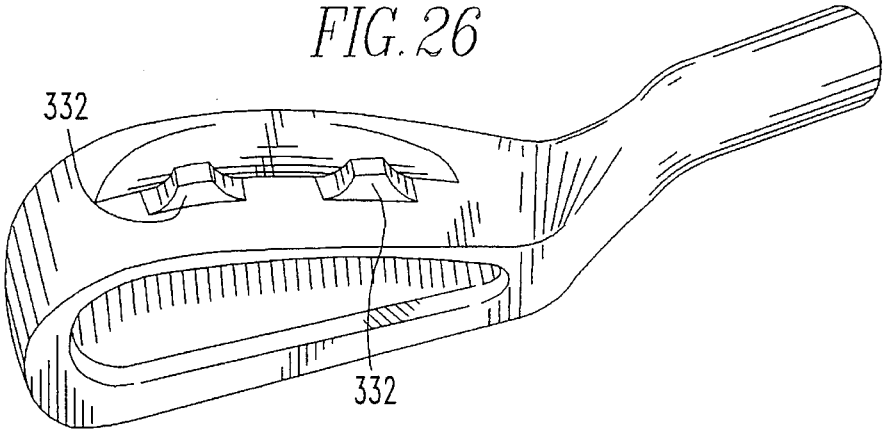
FIG. 26 is a bottom view of a twenty-first embodiment of the present invention.

FIG. 26 generically illustrates that two or more narrow projections 332 can.be formed behind the depressions or projections described in the above embodiments. These narrow projections extend outwardly from the sole 334 and provide at least a pair of runners which dig into the ground or sand, further eliminating potential "bouncing," torquing, or twisting of the club head, thereby providing improved tracking of the club head.

Figure 27:
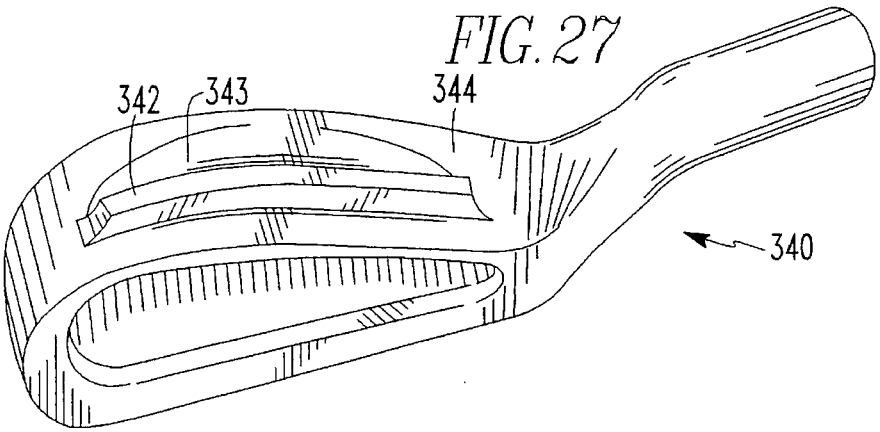
FIG. 27 is a bottom view of a twenty-second embodiment of the present invention.
Figure 27A:
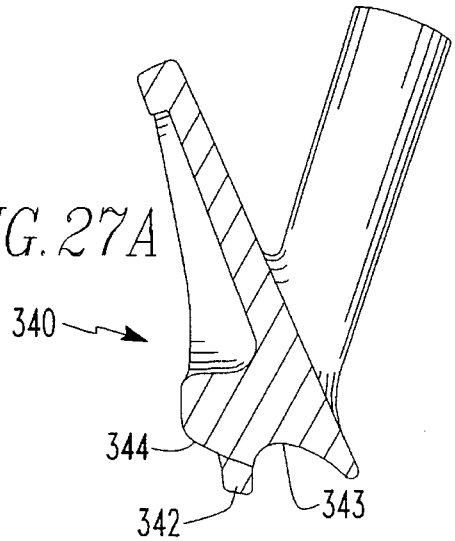
FIG. 27A is a sectional view taken along line 27A—27A of FIG. 27.

FIGS. 27 and 27A illustrate a twenty-second embodiment of the club head 340 of the present invention and is similar to the embodiment shown in FIG. 1, with the exception that it includes a single longitudinal runner-type projection 342, which is approximately 0.125 of an inch high and wide, and is positioned behind the depression 343, which is approximately 0.250 of an inch deep and 0.200–0.400 wide, and extends along substantially the entire length of the sole 344. In this embodiment, the front surface 341 or wall portion of projection 342 may be positioned behind or aligned with the rear wall of the depression 343, which combine to produce larger scoops of sand during a sand shot.

While various preferred embodiments have been shown and described, it will be understood that there is no intent to limit the invention by such disclosure, but rather, it is intended to cover all modifications and alternate construction falling within the spirit and scope of the invention as defined in the appended claims.

What is claimed:

1. An iron-type golf club head for hitting a golf ball comprising:

golf club head body having a heel, toe, top ridge, sole, rear club face having a trailing edge at the intersection of the sole and the rear club face, and a lofted ball striking face having a loft of at least 12° with a forwardmost progression forming a leading edge at the intersection of the sole and the ball striking face;

control means altering the surface of the sole of the club head for contacting ground surfaces and providing greater control and stability during the execution of golf shots, the control means extending between the heel and the toe and having at least one substantially vertical wall, the at least one substantially vertical wall facing the leading edge of the club head and being spaced behind the leading edge of the club head.

2. The golf club head of claim 1 wherein the control means includes a cavity extending between the heel and the toe, the cavity extending at least one-quarter of the width of the sole between the leading and trailing edges of the club head, and the at least one substantially vertical wall positioned behind the cavity and having a height of at least ⅛ of an inch.

3. The golf club head of claim 2 further comprising at least two narrow projections positioned behind the control means in a front to rear direction and extending outwardly from the sole.

4. The golf club head of claim 3 wherein the projections are positioned adjacent the trailing edge of the club head.

5. The golf club head of claim 1 wherein the control means includes a plurality of cavities formed in the sole.

6. The golf club head of claim 5 wherein the plurality of cavities are arranged parallel to each other.

7. The golf club head of claim 5 wherein the cavities include flared ends at the heel and toe.

8. The golf club head of claim 5 wherein the cavities extend from adjacent the heel to adjacent the toe.

9. The golf club head of claim 5 wherein the cavities are angled diagonally with respect to the leading and trailing edges.

10. The golf club head of claim 5 wherein the cavities are arranged in a cross-hatched configuration on the sole.

11. The golf club head of claim 5 wherein the plurality of cavities form an array between the heel and the toe.

12. The golf club head of claim 5 wherein the plurality of cavities are formed in rows and each of the rows is parallel to the other.

13. The golf club head of claim 11 wherein the plurality of cavities are half-mooned shaped.

14. The golf club head of claim 11 wherein the plurality of cavities are oval shaped.

15. The golf club head of claim 11 wherein the plurality of cavities are straight.

16. The golf club head of claim 11 wherein the plurality of cavities are curved.

17. The golf club head of claim 5 wherein the plurality of cavities are curved toward the leading edge.

18. The golf club head of claim 5 wherein the plurality of cavities are curved toward the trailing edge.

19. The golf club head of claim 1 wherein the control means are projections extending between the heel and the toe.

20. The golf club head of claim 19 wherein the projections are triangular shaped members.

21. The golf club head of claim 19 wherein the projections are arranged in a cross-hatched configuration on the sole.

22. The golf club head of claim 1 wherein the control means includes a pair of projections extending outwardly from the sole.

23. The golf club head of claim 19 wherein the projections are raised members having a height of at least 1/16 of an inch from the sole.

24. The golf club head of claim 19 wherein the projections have a width in a front to rear direction of at least 1/8 of an inch.

25. An iron-type golf club head for hitting a golf ball comprising:

golf club head body having a heel, toe, top ridge, sole, rear club face having a trailing edge at the intersection of the sole and the rear club face, and a lofted ball striking face having a loft of at least 12° with a forwardmost progression forming a leading edge at the intersection of the sole and the ball striking face;

control means integrally formed in the sole of the club head for contacting ground surfaces and providing greater control and stability during the execution of the golf shot and being spaced behind the leading edge of the club head, the control means extending between the heel and the toe, the control means including one or more cavities having a wall facing the leading edge of the club head.

26. The golf club head of claim 25 wherein the control means includes a plurality of the cavities.

27. The golf club head of claim 26 wherein the cavities are spaced so that the walls of the cavities cooperate to provide a substantially continuous wall in the heel to toe direction.

28. The golf club head of claim 26 wherein the club head includes at least two rows of cavities extending in a heel to toe direction.

29. The golf club head of claim 25 wherein the control means extends at least 35% of the distance between the heel and the toe.

30. The golf club head of claim 25 wherein the control means extends at least 50% of the distance between the heel and the toe.

31. The golf club head of claim 25 wherein the control means extends at least 70% of the distance between the heel and the toe.

32. An iron-type golf club head for hitting a golf ball comprising:

golf club head body having a heel, toe, top ridge, sole, rear club face having a trailing edge at the intersection of the sole and the rear ciub face, and a lofted ball striking face having a loft of at least 12° with a forwardmost progression forming a leading edge at the intersection of the sole and the ball striking face;

control means integrally formed to the sole of the club head for contacting ground surfaces and providing greater control and stability during the execution of the golf shot and being spaced behind the leading edge of the club head, the control means extending between the heel and the toe, the control means including one or more projections having a frontal wall facing the leading edge of the club head.

33. The golf club head of claim 32 wherein the control means includes a plurality of the projections.

34. The golf club head of claim 33 wherein the projections are spaced so that the walls of the projections cooperate to provide a substantially continuous wall in the heel to toe direction.

35. The golf club head of claim 33 wherein the club head includes at least two rows of projections extending in a heel to toe direction.

36. The golf club head of claim 33 wherein the control means extends at least 35% of the distance between the heel and the toe.

37. The golf 61ub head of claim 33 wherein the control means extends at least 50% of the distance between the heel and the toe.

38. The golf club head of claim 32 wherein the control means extends at least 70% of the distance between the heel and the toe.

39. An iron-type golf club head for hitting a golf ball off of a sandy surface, the iron-type golf club comprising:

golf club head body having a heel, toe, top ridge, sole, rear club face having a trailing edge at the intersection of the sole and the rear club face, and a lofted ball striking face having a loft of at least 40° with a forwardmost progression forming a leading edge at the intersection of the sole and the ball striking face;

means on the sole of the club head, including an elongated surface extending outwardly from the sole in a direction substantially perpendicular to the sole of the club head for catching and throwing a substantial amount of sand forward along a low trajectory at the golf ball as the ball is hit from the sandy surface.

40. The iron-type golf club head of claim 39 wherein the means for catching and throwing sand includes a deep cavity-like depression aligned in a heel to toe direction, the depression having the elongated, substantially perpendicular surface at a rearward portion of the depression.

41. The iron-type golf club head of claim 40 wherein said depression has a leading edge spaced slightly rearwardly of the leading edge of the club head and a rearwardly sloping surface between the leading edge of the depression and said elongated, substantially perpendicular surface.

* * * * *

UNITED STATES PATENT AND TRADEMARK OFFICE

CERTIFICATE OF CORRECTION

PATENT NO. : 5,603,668

DATED : February 18, 1997

INVENTOR(S) : Anthony J. ANTONIOUS

It is certified that error appears in the above-indentified patent and that said Letters Patent is hereby corrected as shown below:

Claim 32, col. 10, line 12, change "ciub" to --club--.

Claim 37, col. 10, line 36, change "6lub" to --club--.

Signed and Sealed this

Thirteenth Day of May, 1997

*Attest:*

*Attesting Officer*

BRUCE LEHMAN

*Commissioner of Patents and Trademarks*